United States Patent [19]

Sai et al.

[11] Patent Number: 5,076,562

[45] Date of Patent: Dec. 31, 1991

[54] SHEET FEEDER

[75] Inventors: Yoshinobu Sai; Toshiaki Sannohe, both of Miyagi; Keiichi Chiba, Iwanuma, all of Japan

[73] Assignee: Ricoh Company, Ltd., Tokyo, Japan

[21] Appl. No.: 517,172

[22] Filed: May 1, 1990

[30] Foreign Application Priority Data

| | | | |
|---|---|---|---|
| May 2, 1989 | [JP] | Japan | 1-51598[U] |
| May 25, 1989 | [JP] | Japan | 1-60497[U] |
| Mar. 2, 1990 | [JP] | Japan | 2-51329 |

[51] Int. Cl.[5] ..... B65H 3/44

[52] U.S. Cl. ..... 271/9; 271/241; 271/253; 271/159; 271/164; 271/171

[58] Field of Search ..... 271/4, 9, 145, 147, 271/157-159, 162, 164, 171, 241, 253, 255; 221/122

[56] References Cited

U.S. PATENT DOCUMENTS

| | | | |
|---|---|---|---|
| 3,986,620 | 10/1976 | Wilde et al. | 414/790.4 |
| 4,451,191 | 5/1984 | Torre | 271/157 |
| 4,703,924 | 11/1987 | Marass | 271/158 |
| 4,765,790 | 8/1988 | Besemann | 414/790.4 |
| 4,843,962 | 7/1989 | Neelman et al. | 271/9 |
| 4,927,051 | 5/1990 | Falk et al. | 221/122 |

FOREIGN PATENT DOCUMENTS

| | | | |
|---|---|---|---|
| 194957 | 11/1984 | Japan | 271/9 |
| 139833 | 6/1988 | Japan | 271/164 |

*Primary Examiner*—H. Grant Skaggs
*Assistant Examiner*—Boris Milef
*Attorney, Agent, or Firm*—Oblon, Spivak, McClelland, Maier & Neustadt

[57] ABSTRACT

A sheet feeder for feeding sheets into a copying or printing machine includes a movable base movably mounted on a fixed base for movement across a sheet inlet of the copying or printing machine in a direction perpendicular to the direction in which the sheets are fed into the copying or printing machines. Two sheet tables for carrying respective stacks of sheets thereon are juxtaposed along the direction in which the movable base is movable, and is mounted on the movable base, so that a selected one of the sheet tables can be positioned at the sheet inlet in response to movement of the movable base. The selected sheet table is lifted by a lifter mechanism associated therewith to elevate the supported sheets until the uppermost one of the sheets reaches a sheet feeding position. The sheets are then successively fed from the selected sheet table into the sheet inlet.

6 Claims, 6 Drawing Sheets

SHEET FEEDER

BACKGROUND OF THE INVENTION

1. Field of the Invention

The present invention relates to a sheet feeder for use with a copying machine, a printing machine, or the like.

2. Prior Art

There are known various sheet feeders for holding a stack of sheets and successively supplying the sheets to copying machines, printing machines, or the like.

One conventional sheet feeder is of the deck type which supports a stack of sheets on a horizontal deck. The sheet feeder is movable between a sheet feeding position in a copying machine, a printing machine, or the like and an exposed position out of the machine, so that the sheet feeder can easily be replenished with new sheets and serviced. This type of sheet feeder is disclosed in Japanese Laid-Open Patent Publication No. 55(1980)-56927 and Japanese Laid-Open Utility Model Publication No. 55(1980)-7065.

Another known sheet feeder, referred to as a double-deck sheet feeder, has upper and lower deck-type sheet tables disposed in a sheet feeding position in a copying machine, a printing machine, or the like, as disclosed in Japanese Patent Publication No. 50(1975)-38968.

Japanese Laid-Open Utility Model Publication No. 52(1977)-36930 shows a cassette-type sheet feeder which includes a sheet cassette storing a stack of sheets. The sheet cassette is loaded in a sheet feeding position in a copying machine, a printing machine, or the like.

Japanese Laid-Open Patent Publication No. 54(1979)-41734 discloses a hybrid sheet feeder which comprises a deck-type sheet table and a cassette-type sheet table.

Generally, copying machines are supplied with sheets which are of different sizes but constant physical properties. The copying machines are equipped with a plurality of vertically arranged sheet cassettes or tables. In operation, one of the sheet cassettes or tables is selected, and sheets are successively fed from the selected sheet cassette or table into the copying machine. The sheets from the sheet cassette or table are delivered through a somewhat complex feed path such as a curved feed path, but do not suffer a feed failure or sheet jam frequently.

Printing machines, on the other hand, are usually supplied with sheets of varying physical qualities, such as thinner and thicker sheets. If the feed path for feeding sheets from the sheet feeder to the printing machine is complex or excessively tortuous, thinner sheets may fail to be fed successfully and thicker sheets may be jammed.

To avoid the above difficulties, ordinary printing machines are equipped with sheet feeders having only one sheet table from which sheets are supplied through a straight sheet path. When sheets of a different size or quality are to be used, however, the printing machine has to be shut down, and the existing sheets have to be replaced with new sheets of a desired size or quality. Because of this interruption or temporary shut-off of the printing machine, the efficiency of the printing machine is lowered by the sheet replacement.

One solution to the above problem is to employ a plurality of movable sheet tables with casters, and to couple one of the sheet tables which stores desired sheets to the printing machine for feeding the sheets. Since the movable sheet tables are independent of the printing machine, it is time-consuming to position any desired sheet table accurately with respect to the printing machine. Accordingly, the printing machine used with these movable sheet tables are still not efficient enough.

It is desirable that a sheet table for use with a printing machine be able to support a large number of sheets of different types, to allow sheet types to be selected and replaced with ease, and also to facilitate maintenance of the stored sheets.

The conventional deck-type sheet feeder disclosed in the first two publications referred to above can hold a large number of sheets, but has only one sheet storage space. When sheets of a different type (size, thickness, or other properties) are to be used, it is necessary to remove the existing sheets from the sheet feeder and then put the desired sheets into the sheet feeder. Special care must be taken to keep the removed sheets in order. Accordingly, a tedious and time-consuming sheet replacing process is needed regardless of the high-speed sheet feeding operation performed by the sheet feeder and demands for automatization of manual operations.

The double-deck sheet feeder shown in the second publication also has disadvantages. The copying or printing machines with which the double-deck sheet feeder is to be used have a limited vertical space available in their sheet inlet region. When the lower sheet table is used, the upper sheet table has to be empty. The sheet tables cannot therefore be automatically selected. The upper sheet table must be taken out manually.

The cassette-type sheet feeder according to the third publication fails to hold a large number of sheets at one time because of the structural limitations and weight of the sheet cassette itself. If a number of sheet cassettes are set in a vertical array, they should be coupled to respective sheet feed mechanisms.

The hybrid sheet feeder disclosed in the fourth publication is only used as an auxiliary sheet feeder since it cannot store a large number of sheets, as with the cassette-type sheet feeder.

Therefore, any of the conventional sheet feeders cannot support a large number of sheets of varying kinds at one time, have limitations on automatization of sheet table selection and on reduction of the space occupied by the sheet table or tables.

SUMMARY OF THE INVENTION

It is an object of the present invention to provide a sheet feeder which can feed sheets without a feed failure or a sheet jam even when a plurality of sheet tables are employed.

Another object of the present invention is to provide a sheet feeder which can hold a large number of sheets of different types at one time, can automatically select a desired one of sheet tables, and has a reduced space occupied by the sheet table.

According to the present invention, there is provided a sheet feeder for feeding sheets in one direction, comprising a fixed base, a movable base movably mounted on the fixed base for movement across a sheet inlet in a direction perpendicular to said one direction, a plurality of sheet tables for carrying respective stacks of sheets thereon, the sheet tables being juxtaposed along the direction and mounted on the movable base, so that a selected one of the sheet tables can be positioned at the sheet inlet in response to movement of the movable base, a plurality of lifter mechanisms associated respectively with the sheet tables, for lifting the sheet tables, the lifter mechanisms being selectively operable to lift the selected one of the sheet tables until the uppermost one of the sheets on the selected one of the sheet table reaches a sheet feeding position, and sheet feed means for feeding the sheets from the selected one of the sheet tables into the sheet inlet at the sheet feeding position.

The sheets carried on the sheet tables can be selectively fed by the same sheet feed means. Since sheets of different sizes or properties can be supported on the sheet tables, tedious and time-consuming processes for replacing the sheets are usually not required. While the sheets are being fed from the selected one sheet table, the sheets on the other sheet table may be replenished or replaced. The efficiency of operation of the sheet feeder is therefore high, and a large number of sheets of different kinds can be stored on the sheet tables. As only one sheet feed means is used, the sheet feed path is relatively simple and does not cause a feed failure or a sheet jam.

According to the present invention, there is also provided a sheet feeder for feeding sheets in one direction along a sheet feed path, comprising a fixed mount base, a movable base movably mounted on the fixed base for movement across a sheet inlet in a direction perpendicularly to said one direction, base actuator means for reciprocally moving the movable base on the fixed mount base, a first sheet table for supporting a stack of first sheets, the first sheet table being vertically movably mounted on the movable base, a second sheet table for supporting a stack of second sheets, the second sheet table being vertically movably mounted on the movable base, the second sheet table being positioned adjacent to the first sheet table along said direction, sheet feed means for feeding the sheets from a selected one of the first and second sheet tables, first table lifter means for vertically moving the first sheet table toward and away from the sheet feed means, second table lifter means for vertically moving the second sheet table toward and away from the sheet feed means, a guide side plate substantially vertically mounted on the movable base between the first and second sheet tables and extending toward the sheet inlet in the one direction, a first movable side fence for positioning the stack of first sheets against the guide side plate, the first movable side fence being disposed in confronting relation to a side of the sheet guide side plate which faces the first sheet table and movable toward and away from the guide side plate, a second movable side fence for positioning the stack of second sheets against the guide side plate, the second movable side fence being disposed in confronting relation to a side of the sheet guide side plate which faces the second sheet table and movable toward and away from the guide side plate, a first detectable sheet center indicator positioned in alignment with an intermediate central position between the guide side plate and the first movable side fence, and movable along an indicator path by a distance which is ½ of the distance by which the first movable side fence moves, in response to the movement of the first movable side fence, a second detectable sheet center indicator positioned in alignment with an intermediate central position between the guide side plate and the second movable side fence, and movable along the indicator path by a distance which is ½ of the distance by which the second movable side fence moves, in response to the movement of the second movable side fence, and sheet center detector means disposed at a central position of the sheet feed path and in the indicator path, for detecting either the first detectable sheet center indicator or the second detectable sheet center indicator to produce a signal for stopping movement of the movable base.

The sheet tables can selectively be displaced into a position in front of the sheet inlet while the transverse center of the supported sheets is aligned with the central position of the sheet feed path. The sheet tables can support a large number of sheets of different kinds, and can automatically be selected for feeding desired sheets into the sheet inlet. The sheet feeder occupies a relatively small space.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
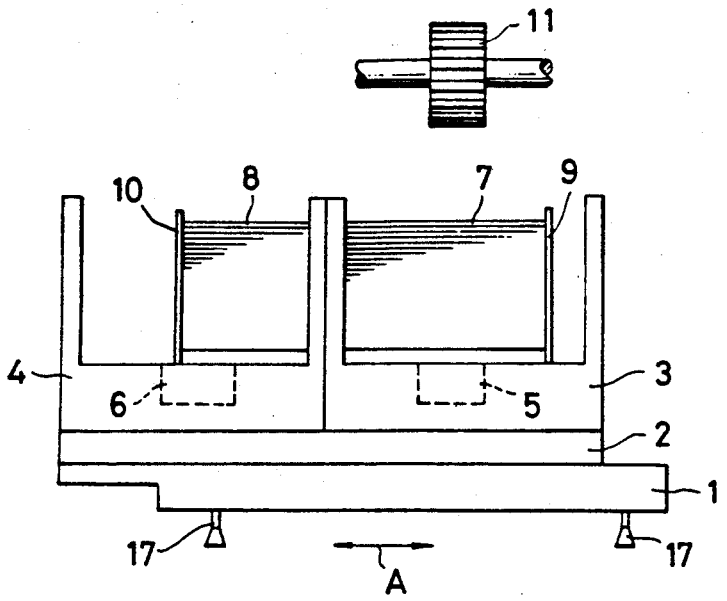
FIG. 1 is a schematic front elevational view of a sheet feeder according to an embodiment of the present invention.
Figure 2:
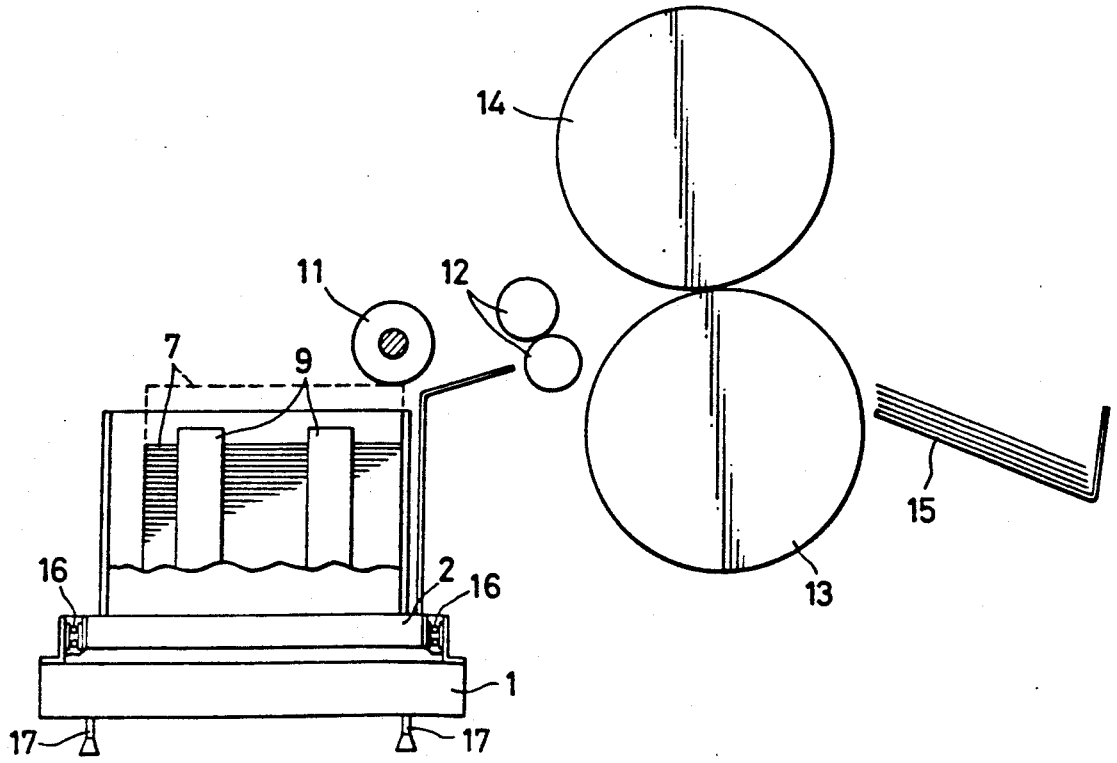
FIG. 2 is a schematic side elevational view of a printing machine which is combined with the sheet feeder shown in FIG. 1.

FIGS. 1 and 2 show a sheet feeder according to an embodiment of the present invention.

As shown in FIGS. 1 and 2, the sheet feeder has a base 1 fixedly mounted on an offset printing machine. The sheet feeder also has a movable base 2 slidably mounted on the fixed base 1 by a pair of sliders 16 at opposite sides thereof. The movable base 2 is slidable back and forth in the directions indicated by the arrow A (FIG. 1), which are perpendicular to the direction (normal to the sheet of FIG. 1) in which sheets are fed from the sheet feeder into the offset printing machine.

Two sheet tables 3, 4 are mounted on the movable base 2 and juxtaposed substantially horizontally along the directions A. The height and horizontality of the fixed base 1 are adjustable by adjuster bolts 17 attached to the lower surface of the fixed base 1.

The sheet tables 3, 4 have respective lifter mechanisms 5, 6 for lifting respective stacks of sheets 7, 8 on the sheet tables 3, 4 and respective side fences 9, 10 which are horizontally on the sheet tables 3, 4 to positions corresponding to the sizes of the sheets of the sheets 7, 8.

A sheet feed mechanism including a sheet feed roller 11 in the printing machine is disposed above the sheet tables 3, 4. The sheet feed roller 11 is fixed in a predetermined position, and one of the sheet tables 3, 4 is selectively positionable below the sheet feed roller 11. In FIG. 1, the sheet table 3 is located downwardly of the sheet feed roller 11, and hence is in a position to feed the sheets 7 to the printing machine.

The movable base 2 is movable in a range in which each of the sheet tables 3, 4 can be brought into the position to feed the sheets 7, 8 to the printing machine. Stated otherwise, the movable base 2 is movable between a position in which the sheet table 3 is below the sheet feed roller 11 and can feed the sheets 7 to the printing machine and a position in which the sheet table 4 is below the sheet feed roller 11 and can feed the sheets 8 to the printing machine.

It is assumed that the sheets 7 carried on the sheet table 3 is of A3 size and the sheets 8 carried on the sheet table 4 is of A4 size, and that the sheet table 3 is in the position to feed the sheets 7, as shown in FIG. 1.

If the sheets 7 of A3 size are to be printed by the printing machine, the movable base 2 is not moved since the movable base 2 is already in the position to feed the sheets 7 to the printing machine.

If the sheets 8 of A4 size are to be printed by the printing machine, the movable base 2 is moved to the right in FIG. 1 until the sheet table 4 is in the position to feed the sheets 8, i.e., below the sheet feed roller 11. When the printing process is started, the sheets 8 on the sheet table 4 are elevated by the lifting mechanism 6 to the sheet feeding position in which the uppermost one of the sheets 8 is held in contact with the sheet feed roller 11 as indicated by the broken line in FIG. 2.

The sheets 8 are then fed, one by one from the uppermost one thereof, to the printing machine. Each sheet 8 is gripped by and between a pair of resist rollers 12 FIG. 2) at given timing, and delivered between an impression cylinder 13 and a rubber blanket cylinder 14. At this time, ink is transferred from the rubber blanket cylinder 14 to the sheet 8, which is now printed, and then the printed sheet 8 is discharged into a discharge sheet ray 15.

Since the sheet feeder shown in FIGS. 1 and 2 is not required to replace the sheets 7, 8, together with the sheet tables 3, 4, with other sheets, the efficiency of printing operation is high when different types of sheets are to be fed from the sheet feeder to the printing machine.

The sheet tables 3, 4 store the respective sheets 7, 8 which are to be printed by the printing machine. Even if one of the sheet tables 3, 4 is running short of sheets, the other sheet table is shifted to the position to feed the sheets for continuous printing operation. While one of the sheet tables is in the sheet feeding position during a printing process, the other sheet table may be replenished with new sheets.

Though the two sheet tables 3, 4 are employed, only a single sheet feed path is required for the sheets 7, 8 to pass therethrough from the sheet feeder to the printing machine. Consequently, the sheet feed path is not complex, and the sheets 7, 8 are prevented from a feed failure or a sheet jam.

In the above embodiment, two sheet tables are 3, 4 are mounted on the movable base 2. However, more than two sheet tables may be mounted on the movable base 2. The movable base 2 may be moved either manually by a person who grips a grip on the movable base 2 or automatically by an actuator such as an electric motor coupled to the movable base 2. Alternatively, the movable base 2 may be moved selectively by the manual operation and the electric motor.

FIGS. 3 through 11 show a sheet feeder in accordance with another embodiment of the present invention.

Figure 3:
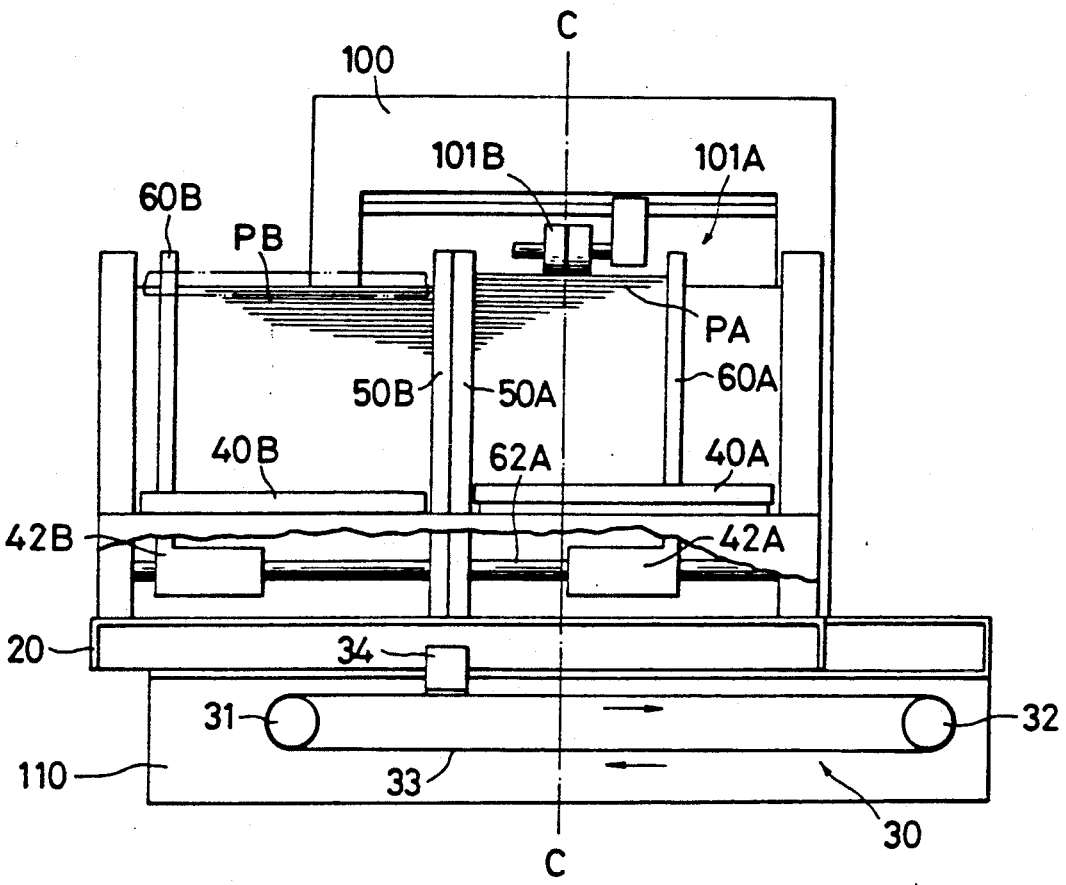
FIG. 3 is a schematic front elevational view of a sheet feeder according to another embodiment of the present invention.

As shown in FIG. 3, the sheet feeder includes a mount base 110 fixedly disposed below a sheet inlet 101A of a frame 100 of a copying or printing machine with which the sheet feeder is used, and a movable base 20 movably mounted on the mount base 110 and reciprocally movable in directions (horizontally-in FIG. 3) perpendicular to the direction (normal to the sheet of FIG. 3) in which sheets are fed from the sheet feeder into the sheet inlet 101A of the printing machine. The movable base 20 can be reciprocally moved by a base actuator mechanism 30 mounted in the mount base 110. The sheet feeder also includes a first sheet table or plate 40A vertically movably disposed on the movable base 20, and a second sheet table or plate 40B vertically movably disposed on the movable base 20, the second sheet table 40B is located adjacent to the first sheet table 40A in the directions in which the movable base 20 is movable. Between the first and second sheet tables 40A, 40B, there is disposed a side plate member, such as a pair of substantially vertical sheet guide side plates 50A, 50B mounted on the movable base 20 and extending in the direction in which the sheets are fed from the sheet feeder into the sheet inlet 101A.

Two first movable side plates or fences 60A (FIG. 8) extend vertically through the first sheet table 40A and are disposed in confronting relation to the side of the sheet guide side plate 50A which faces the first sheet table 40A. The first movable side fences 60A are horizontally movable toward and away from the sheet guide side plate 50A. Similarly, two first movable side plates or fences 60B extend vertically through the second sheet table 40B and are disposed in confronting relation to the side of the sheet guide side plate 50B which faces the first sheet table 40B. The second movable side fences 60B are horizontally movable toward and away from the sheet guide side plate 50B.

A first detectable sheet center indicator finger 70A (FIG. 4) which indicates an intermediate central position between the sheet guide side plate 50A and the first movable side fence 60A is movable with the first movable side fence 60A such that the first detectable sheet center indicator finger 70A always moves a distance which is 1/2 of the distance by which the first movable side fence 60A moves. Likewise, a second detectable sheet center indicator finger 70B (FIG. 4) which indicates an intermediate central position between the sheet guide side plate 50B and the second movable side fence 60B is movable with the second movable side fence 60B such that the second detectable sheet center indicator finger 70B always moves a distance which is ½ of the distance by which the second movable side fence 60B moves. A sheet center detector 80 (FIGS. 10 and 11) is positioned at the central position C—C (FIGS. 3 and 4) of the sheet feed path extending from the sheet feeder into the sheet inlet 101A, and also positioned in the path along which the first and second detectable sheet center indicator fingers 70A, 70B are movable. The sheet center detector 80 produces a base stop signal when it detects the first detectable sheet center indicator finger 70A or the second detectable sheet center indicator finger 70B.

Figure 4:
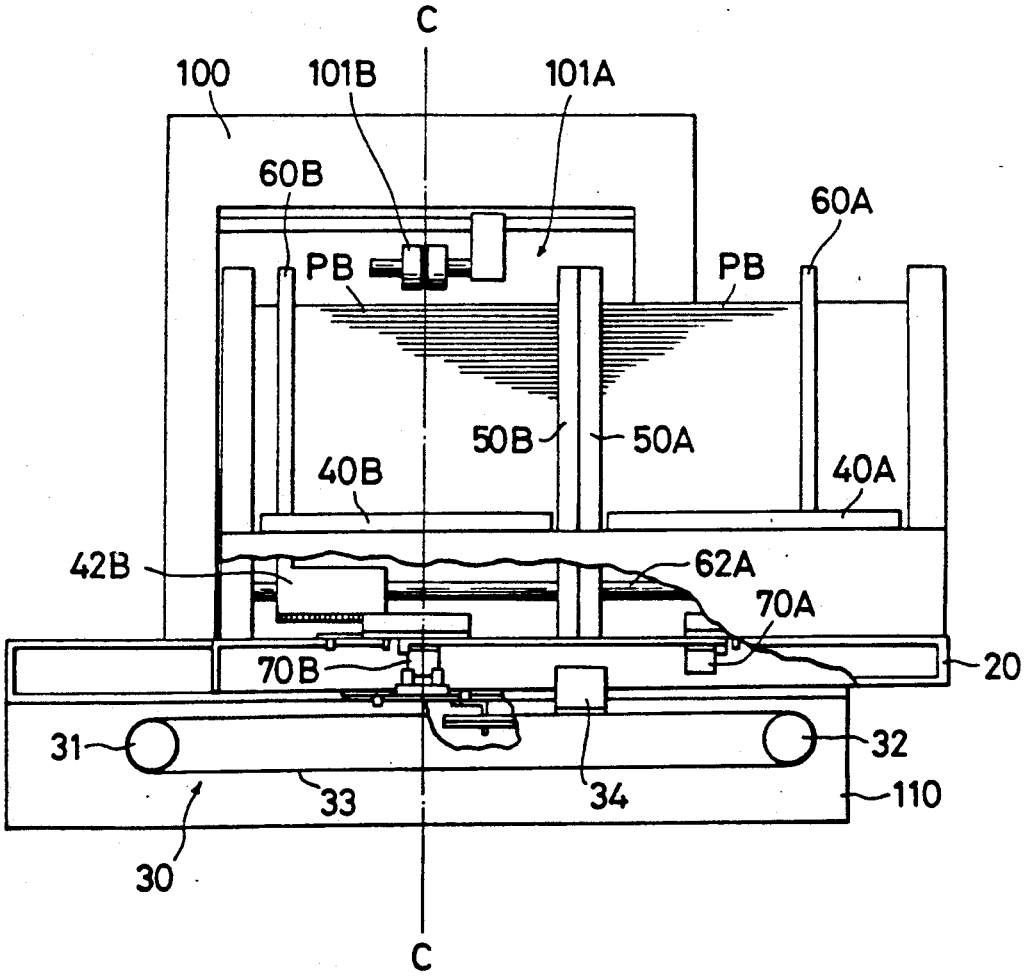
FIG. 4 is a schematic front elevational view of the sheet feeder shown in FIG. 3, showing one mode of operation thereof.

For example, sheets PA of a smaller size are stacked on the first sheet table 40A, whereas sheets PB of a larger size are stacked on the second sheet table 40B, as shown in FIGS. 3 and 4. The sheets PA, PB have edges held in contact with the sheet guide side plates 50A, 50B and opposite edges held in contact with the first and second movable side fences 60A, 60B. Therefore, the sheets PA, PB are securely positioned on the first and second sheet tables 40A, 40B.

The machine frame 100 has a control panel (not shown) which includes sheet selection keys and a ten-key pad. The sheet table 40A or 40B which is to be used and the number of prints or copies to be produced are selected through the sheet selection keys and the ten-key pad.

If the smaller sheets PA are selected, the movable base 20 are moved by the base actuator mechanism 30 until the transverse center of the sheets PA is aligned with the central position C—C of the sheet feed path, as shown in FIG. 3. The manner in which the movable base 20 is stopped will be described in detail later on.

When a print start key (not shown) on the control panel is pressed, the first sheet table 40A is elevated by a first known table lifter mechanism (not shown) to bring the uppermost one of the sheets PA into pressed contact with a sheet feed mechanism including a sheet feed roller 101B which is located in the sheet inlet 101A. The sheet feed roller 101B is rotated at certain intervals of time to feed the sheets PA successively through the sheet inlet 101A toward a processing mechanism (such as an impression cylinder or a photosensitive member) in the machine frame 100.

The first table lifter mechanism is intermittently actuated to lift the first sheet table 40A a the sheets PA are successively consumed. Therefore, the sheets PA are always kept in contact with the sheet feed roller 101B so that they can successively be fed thereby into the sheet inlet 101A. The second sheet table 40B is also elevated by a second known table lifter mechanism which operates in the same manner as the first lifter mechanism.

When the number of sheets PA fed into the sheet inlet 101A reaches a preset sheet count, the sheet feed roller 101B stops its rotation and the first table lifter mechanism is inactivated.

When the sheet selection key for selecting the larger sheets PA on the second sheet table 40B is pressed while the movable base 20 is in the position shown in FIG. 3, the first table lifter mechanism is actuated to lower the smaller sheets PA out of contact with the sheet feed roller 101B. Then, the base actuator mechanism 30 is driven to move the movable base 20 to the right in FIG. 3.

As illustrated in FIGS. 3 and 4, the base actuator mechanism 30 comprises a drive pulley 31 coupled to a reversible actuator such as an electric motor (not shown), a driven pulley 32, an endless belt 33 trained around the drive and driven pulleys 31, 32, and a connector 34 which interconnects the endless belt 33 and the movable base 20.

Upon selection of the larger sheets PB in FIG. 3, the drive pulley 31 is rotated clockwise by the actuator in response to the depression of the sheet selection key, causing the endless belt 33 and the connector 34 to move the movable base 20 to the right on the fixed mount base 110. When the transverse center of the sheets PB is aligned with the central position C—C of the sheet feed path, as shown in FIG. 4, the drive pulley 31 is stopped in its rotation, holding the movable base 20 at rest. Therefore, the larger sheets PB are now in the position in front of the sheet inlet 101A.

When the print start key is pressed, the second sheet table 40B is elevated by the second table lifter mechanism to bring the uppermost one of the sheets PB into pressed contact with the sheet feed roller 101B, which is rotated at certain intervals of time to feed the sheets PB successively through the sheet inlet 101A toward the processing mechanism in the machine frame 100.

The movement and stoppage of the movable base 20 is controlled by the first detectable sheet center indicator finger 70A, the second detectable sheet center indicator finger 70B, and the sheet center detector 80.

As described above, the first and second indicator fingers 70A, 70B are movable with the first and second movable side fences 60A, 60B, respectively, such that the first and second indicator fingers 70A, 70B move respective distances which are ½ of the distances by which the first and second movable side fences 60A, 60B move. When the first and second indicator fingers 70A, 70B have thus moved, they are positioned at the intermediate central positions between the sheet guide side fences 50A, 50B and the movable side plates 60A, 60B, i.e., at the transverse centers of the sheets PA, PB, respectively.

The sheet center detector 80 is located at the central position C—C of the sheet feed path extending into the sheet inlet 101A and also positioned in the path of the first and second indicator fingers 70A, 70B. Upon detection of either the first indicator finger 70A or the second indicator finger 70B, the sheet center detector 80 produces a base stop signal for stopping the movable base 20.

Figure 5:
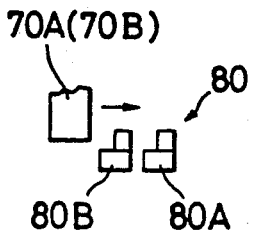
FIGS. 5 through 7 are views showing the manner in which a position detector operates.

When the larger sheets PB are selected while the movable base 20 is in the position shown in FIG. 3, the movable base 20 moves to the right and also the second indicator finger 70B moves to the right with the movable base 20 (see FIG. 5). When the second indicator finger 70B is detected by the sheet center detector 80 (see FIG. 6), i.e., when the transverse center of the sheets PB is aligned with the central position C—C of the sheet feed path, the sheet center detector 80 produces a base stop signal.

The base stop signal is sent to a control unit (such as a microcomputer or the like) in the machine frame 100. The control unit then generates a control signal to stop the rotation of the drive pulley 31, thereby stopping the movement of the movable base 20 in the position shown in FIG. 4.

Figure 6:
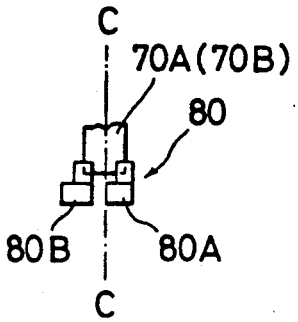
Figure 7:
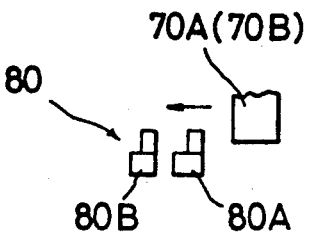

When the smaller sheets PA are selected while the movable base 20 is in the position shown in FIG. 4, the movable base 20 moves to the left and also the first indicator finger 70A moves to the right with the movable base 20 (see FIG. 7). When the first indicator finger 70A is detected by the sheet center detector 80 (see FIG. 6), i.e., when the transverse center of the sheets PA is aligned with the central position C—C of the sheet feed path, the sheet center detector 80 produces a base stop signal. Then, the movable base 20 is stopped in the position shown in FIG. 3 in the same manner as described above.

According to the above mode of controlling the movement and stoppage of the movable base 20, the movable base 20 tends to overrun the desired position due to inertia after the base actuator mechanism is inactivated, because the weight of the sheets PA, PB carried on the movable base 20. The overrunning tendency of the movable base 20 would result in a misalignment of the center of the sheets PA, PB with respect to the central position C—C of the sheet feed path, and hence the sheets PA, PB would be skewed or printed or copied images would be positionally displaced on the sheets PA, PB. To avoid these drawbacks, the movement and stoppage of the movable base 20 should be controlled highly accurately.

As shown in FIG. 6, the sheet center detector 80 comprises first sensor 80A and a second sensor 80B which are positioned closely to each other, one on each side of the central position C—C. The sheet center detector 80 produces a base stop signal when these two sensors 80A, 80B are simultaneously turned on by one of the first and second indicator fingers 70A, 70B.

The sheet center detector 80 can also detect the direction in which the movable base 20 moves from the position where both the sensors 80A, 80B are simultaneously turned on as shown in FIG. 6, by determining whether the sensor 80A or the sensor 80B is first turned on when the indicator finger 70A or 70B moves with the movable base 20 from the position shown in FIG. 6.

When the sheets PB are selected, for example, the indicator finger 70B moves to the right as shown in FIG. 6 and then is detected by the first and second sensors 80A, 80B as shown in FIG. 6. The sheet center detector 80 now produces a base stop signal. If the movable table 20 overruns the position shown in FIG. 6 and moves rightwards toward the position shown in FIG. 7 due to inertia, the second sensor 80B is turned off earlier than the first sensor 80A. The sheet center detector 80 can now detect the rightward overunning movement of the movable base 20, and produces a reversal signal to reverse the drive pulley 31.

The movable base 20 and hence the second indicator finger 70B are moved from the position shown in FIG. 7 back toward the position shown in FIG. 6. If the movable base 20 again overruns the position shown in FIG. 6 and moves leftwards toward the position shown in FIG. 5, then since the first sensor 80A is turned off earlier than the second sensor 80B. The rightward overrunning movement of the movable base 20 is therefore detected, and the drive pulley 31 is rotated in the opposite direction, i.e., clockwise in FIG. 3.

In this manner, the movable base 20 can be stopped with the transverse center of the sheets PB being aligned with the central position C—C of the sheet feed path.

When the sheets PA are selected, the movable base 20 can also be moved and stopped accurately in the desired position in the same manner as when the sheets PB are selected.

The sheets PA, PB carried on the respective sheet tables 40A, 40B may be of any desired sizes. In order to position the sheets PA, PB in front of the sheet inlet 101A while the transverse center of the sheets PA, PB is in alignment with the central position C—C, it is necessary that the indicator fingers 70A, 70B be aligned with the central position C—C irrespective of the sizes of the sheets PA, PB. This requirement is met by the indicator fingers 70A, 70B which move the distance that is ½ of the distance by which the movable side fences 60A, 60B move, in response to the movement of the movable side fences 60A, 60B.

Figure 8:
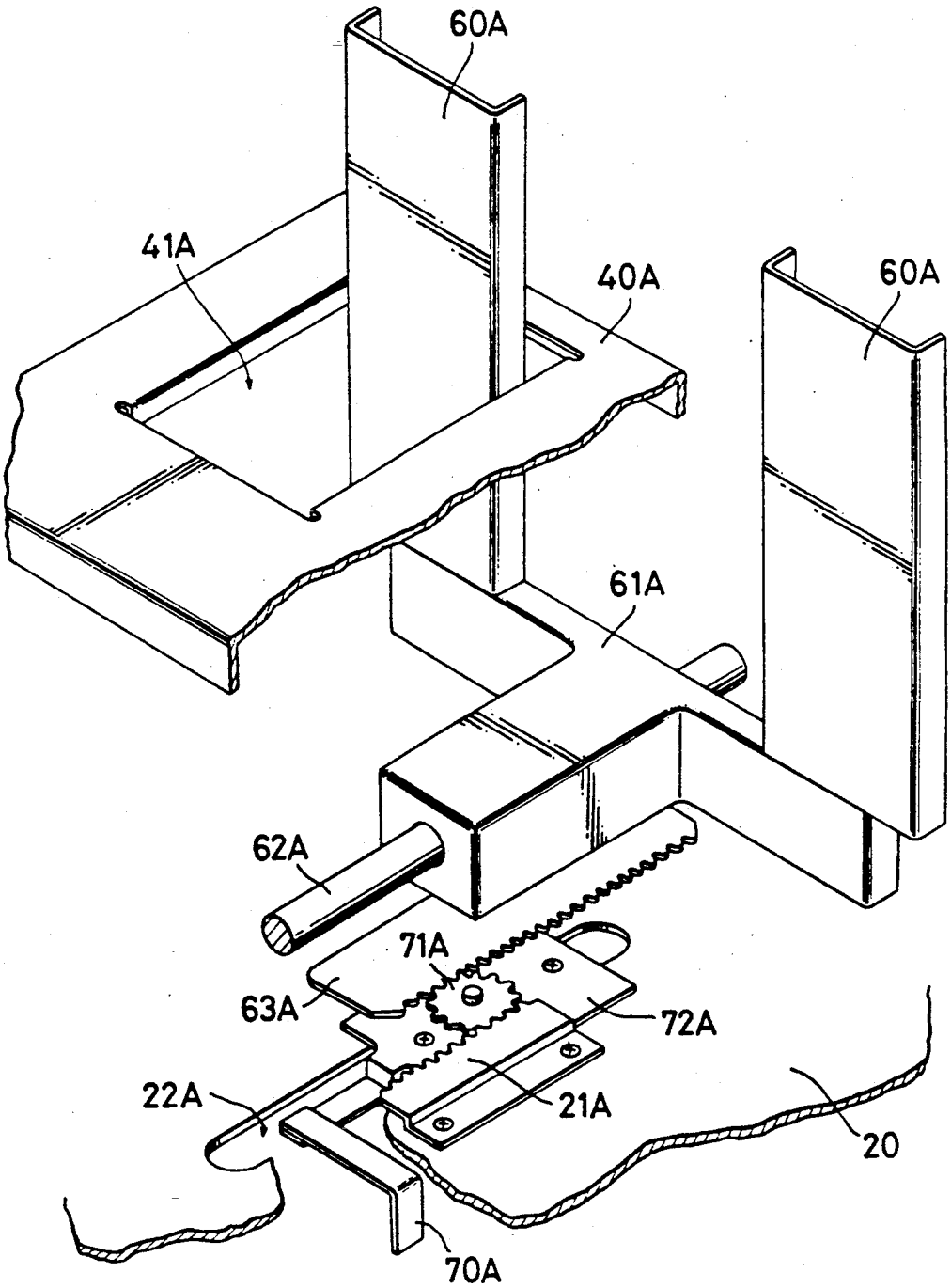
FIG. 8 is a fragmentary perspective view, partly broken away, of a portion of the sheet feeder shown in FIG.
Figure 9:
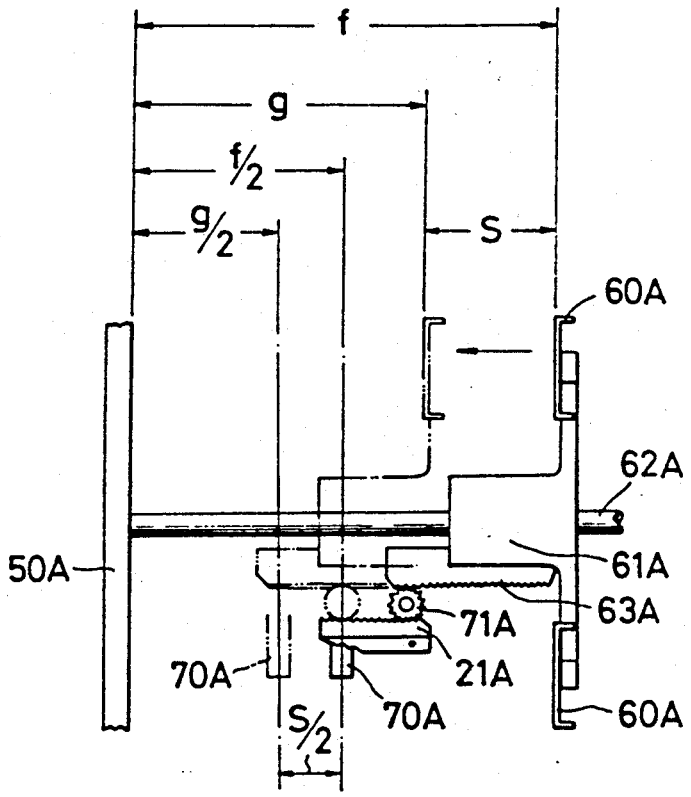
FIG. 9 is a plan view showing the manner in which the portion shown in FIG. 8 operates.

More specifically, as shown in FIGS. 8 and 9, the first movable side fences 60A are substantially vertically mounted on a T-shaped movable block 60A and extend through respective guide holes 41A defined in the sheet table 40A. The movable block 61A is axially slidably supported on a guide shaft 62 which is supported on the movable base 20 and extends parallel to the directions in which the movable base 20 is movable. A movable rack 63A is fixed to the lower surface of the movable block 61A and held in mesh with a pinion 71A which also meshes with a fixed rack 21A parallel to the movable rack 63A. The fixed rack 21A is securely fastened to the upper panel of the movable base 20. The pinion 71A is rotatably mounted on an indicator plate 72A which is disposed in and slidable along an slot 22A which is defined in the upper panel of the movable base 20. The first detectable sheet center indicator finger 70A is attached to one end of the indicator plate 72A. The movable rack 63A, the fixed rack 21A, and the slot 22A extend parallel to the guide shaft 62A.

The first indicator finger 70A has a minimum width which can be detected by the sensors 80A, 80B of the sheet center detector 80. As shown in FIG. 9, when the first movable side fence 60A is spaced a distance of f from the sheet guide side plate 50A, the central position of the first indicator finger 70A is spaced a distance of f/2 from the sheet guide side plate 50A.

Therefore, when the first movable fence 60A is moved a distance of S in the direction indicated by the arrow in FIG. 9, the pinion 71A is also moved in the same direction by a distance of $(\frac{1}{2})S$ because of the movable and fixed racks 63A, 21A meshing with the pinion 71A. Since the pinion 71A is integrally coupled to the first indicator finger 70A through the indicator plate 72A slidable along the slot 22A, the first indicator finger 70A is also moved in the same direction by the distance of $(\frac{1}{2})S$ with the pinion 71A in response to the movement of the first movable side fence 60A.

After the first movable fence 60A has thus been displaced, it is spaced from the sheet guide side plate 50A by a distance of $g=f-S$, and the central position of the first indicator finger 70A is spaced from the sheet guide side plate 50A by a distance of $x=(\frac{1}{2})f-S=(f-S)/2$. Since $f-S=g$, the distance of x is expressed by $x=(\frac{1}{2})g$. Accordingly, the central position of the first indicator finger 70A is positioned exactly in the intermediate central position between the sheet guide side plate 50A and the first movable fence 60A.

Since the distance S is of any desired value, the central position of the first indicator finger 70A is located at the transverse center of the sheets PA placed on the first sheet table 40A and having a transverse dimension or width of S.

The second movable side fence 60B and the second detectable sheet center indicator finger 70B are structurally identical to the first movable side fence 60A and the first detectable sheet center indicator finger 70A, though they move in the opposite directions.

Printing machines or the like which are equipped with sheet feeders generally have a fine adjustment mechanism for finely adjusting the position of the sheet feeder.

One conventional fine adjustment mechanism comprises an adjustment handle or knob on the sheet feeder, which is manually turned to move the sheet feeder (see Japanese Laid-Open Utility Model Publications Nos. 55(1980)-160338 and 50(1975)-13638, for example).

The prior fine adjustment mechanism requires that the operator be moved to the sheet feeder and operate the fine adjustment mechanism each time the sheet feeder is to be adjusted in position. The amount of fine adjustment has to be confirmed on a graduated plate on the sheet feeder.

According to the present invention, as described above, the transverse position of the sheets PA, PB can easily be changed simply by displacing the central position of the first and second indicator fingers 70A, 70B horizontally with respect to the central position C—C of the sheet feed path.

A fine adjustment mechanism according to the present invention will now be described below.

Figure 10:
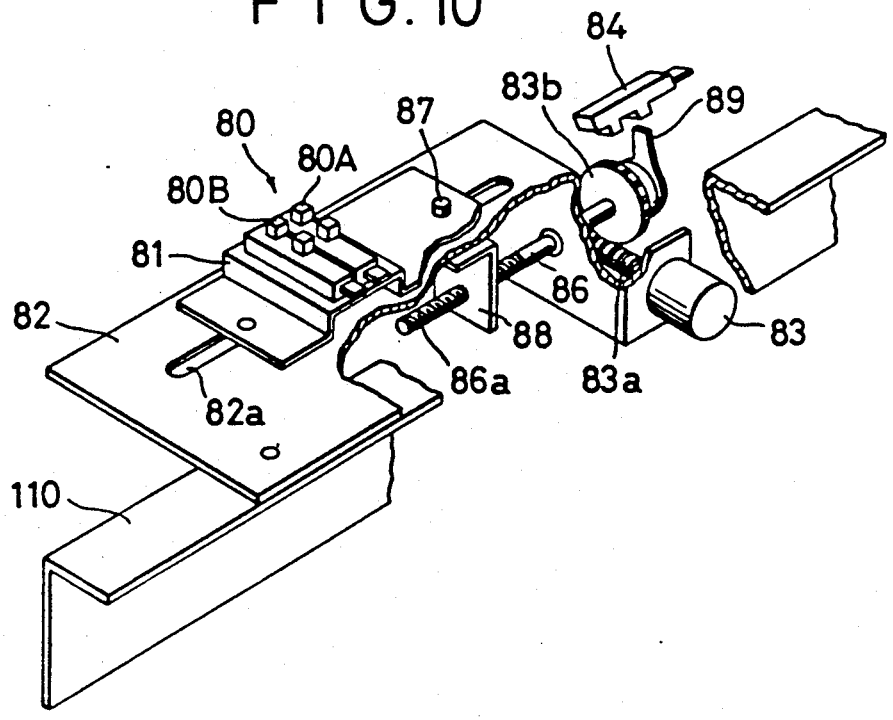
FIG. 10 is a fragmentary perspective view of a fine adjustment mechanism in the sheet feeder shown in FIG. 3.

As shown in FIG. 10, the fine adjustment mechanism comprises a sensor base 81 on which the sensors 80A, 80B, typically photosensors, of the sheet center detector 80 are mounted, a support frame 82, a drive motor 83, and a position sensor 84.

The sensor base 81 is movably mounted on the support frame 82 and slidable along a guide groove 82*a* which is defined in the support frame 82 parallel to the directions in which the movable base 20 is movable. The support frame 82 is fixedly attached to the fixed mount base 110. The drive motor 83 is mounted on the support frame 82 and is rotatable selectively in opposite directions in response to a control signal from a fine adjustment key (not shown) on the control panel. A worm 83*a* is fixed to the rotatable shaft of the drive motor 83 and held in mesh with a worm wheel 83*b*. The worm wheel 83*b* is fixed to one end of a support shaft 86 extending parallel to the guide groove 82*a* and rotatably supported by the support frame 82. The support shaft 86 has a coaxial feed screw 86*a* on the other end portion thereof remote from the worm wheel 83*b*. The feed screw 86*a* is threaded through a bracket 88 which is integrally fastened to the sensor base 81 by a pin 87 fitted in the guide groove 82*a*.

A detectable plate 89 is affixed to the end of the support shaft 86 near the worm wheel 83*b*. The position sensor 84 is positioned in the circular path of the detectable plate 89.

The feed screw 86*a* has a pitch of 1 mm. When the feed screw 86*a* makes one revolution about its own axis, the detectable plate 89 moves once across the path of a light beam emitted by the position sensor 84, which then produces an on/off signal.

In operation, the fine adjustment key on the control panel is pressed to energize the drive motor 83. The worm 83*a* and the worm wheel 83*b* are rotated to rotate the feed screw 86*a* of the support shaft 86, causing the bracket 8, the pin 87, and the sensor base 81 to displace the sensors 80*a*, 80*b* of the sheet center detector 80 along the directions in which the movable base 20 is movable.

The sensors 80A, 80B move a distance of −1 mm each time the feed screw 86*a* makes one revolution or rotates 360° about its own axis. Each time the sensors 80A, 80B move a distance of 1 mm, the position sensor 84 produces a single pulse signal. A value indicating the product of the number of pulses produced by the position sensor 84 and the pitch (1 mm) of the feed screw 86*a* may be displayed on the control panel. Therefore, the distance by which the sensors 80A, 80B are displaced from the original position where the central position of the sheet center detector 80 is aligned with the central position C—C of the sheet feed path, i.e., the amount by which the sheet feeder is finely adjusted in position, can be known and controlled on the control panel.

Figure 11:
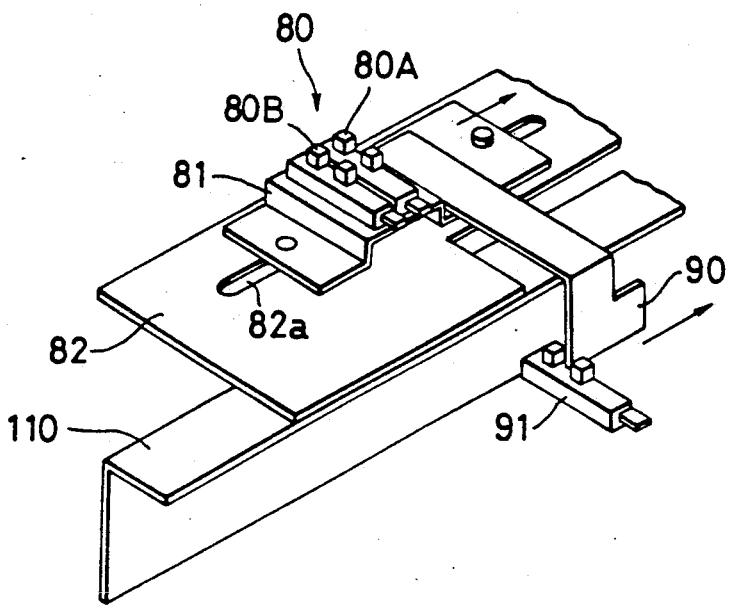
FIG. 11 is a fragmentary perspective view of an original position detector in the fine adjustment mechanism shown in FIG. 10.

FIG. 11 shows an arrangement for detecting the original position of the sheet center detector 80. A origin plate 90 is fixed to the sensor base 81, and an origin sensor 91 is disposed in the path of the origin plate 90. When the sensor base 81 is moved by the drive motor 83 in the direction indicated by the arrow from a position where a light beam emitted by the origin sensor 91 is blocked by the origin plate 90, the origin sensor 90 is turned on, i.e., the light beam is transmitted to a light detecting element. After the origin sensor 91 is turned on, the detectable plate 89 is detected by the position sensor 84 for the first time, whereupon the drive motor 83 is de-energized to stop the sensor base 81. This position, in which the sensor base 81 is stopped, is then used as the original position of the sensors 80A, 80B, i.e., the sheet center detector 80.

In the above embodiment, the first and second sheet tables 40A, 40B are arranged to support stacked sheets of maximum sizes. If a large number of sheets of one size are successively printed or copied, then these sheets are placed on the sheet tables 40A, 40B. When all the sheets are fed from one of the sheet tables 40A, 40B, the movable base 20 is shifted over automatically, and the sheets on the other sheet table can be fed successively. Therefore, the copying or printing machine with which the sheet feeder according to the present invention is used can continuously be operated.

While the sheets are being successively fed from one of the sheet tables 40A, 40B, the sheets on the other sheet table ma be replenished or replaced.

Figure 12:
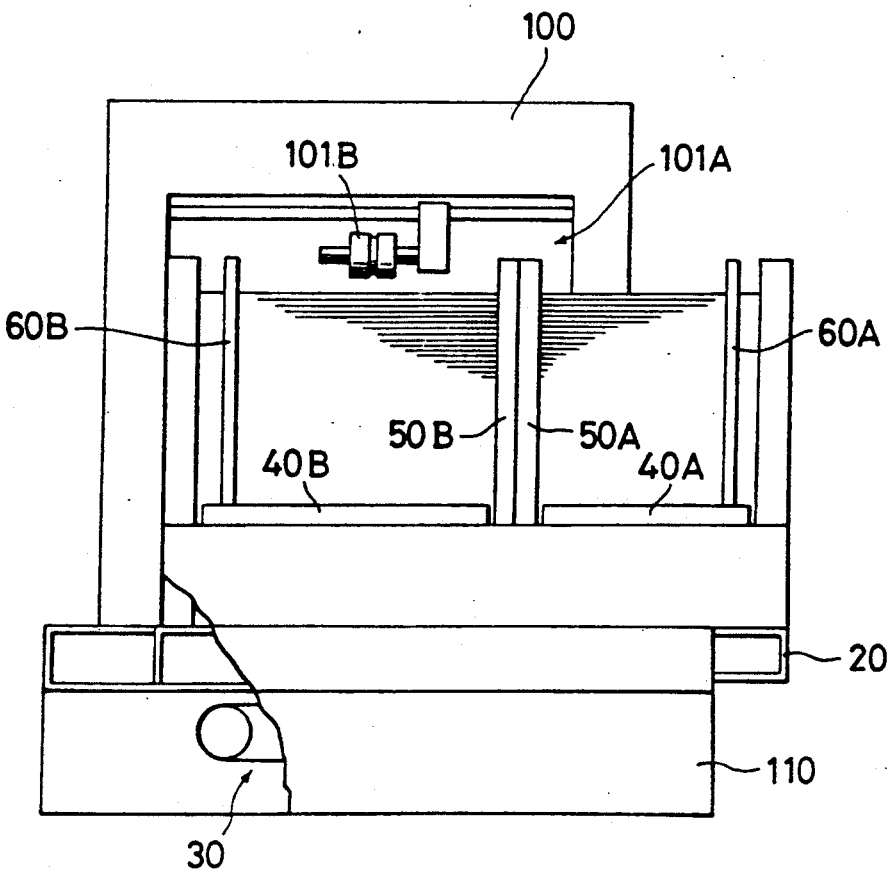
FIG. 12 is a schematic front elevational view of a sheet feeder according to still another embodiment of the present invention.

FIG. 12 shows a sheet feeder according to still another embodiment of the present invention. The sheet feeder shown in FIG. 12 includes a first sheet table 40A which is of a predetermined size for supporting sheets of a certain small size only. The sheet feeder thus arranged takes up a smaller space.

Although certain preferred embodiments have been shown and described, it should be understood that many changes and modifications may be made therein without departing from the scope of the appended claims.

We claim as our invention:

1. A sheet feeder for feeding sheets in one direction, comprising:

a fixed base;

a movable base movably mounted on said fixed base for movement across a sheet inlet in a direction perpendicular to said one direction;

a plurality of sheet tables for carrying respective stacks of sheets thereon, said sheet tables being juxtaposed along said direction and mounted on said movable base, so that a selected one of said sheet tables can be positioned at the sheet inlet in response to movement of said movable base;

a side plate member vertically mounted on said movable base between said plurality of sheet tables and extending toward said sheet inlet inn said one direction;

movable side fences for positioning said stacks of sheet against said side plate member, said movable side fences being disposed in confronting relation to a side of said side plate member and being movable toward and way from said side plate member;

a plurality of lifter mechanisms associated respectively with said sheet tables, for lifting the sheet tables, said lifter mechanisms being selectively operable to lift said selected one of the sheet tables until the upper most one of the sheets on said selected one of the sheet tables reaches a sheet feeding position; and sheet feed means for feeding the sheets from said selected one of the sheet tables into said sheet inlet at said sheet feeding position.

2. A sheet feeder according to claim 1, wherein each of said sheet tables includes a detectable sheet center indicator positioned in alignment with an intermediate central position between said side plate member and one of said movable side fences. said detectable sheet center indicator is detected by sheet center detector means disposed at a central position of said sheet feed path and in a path of said indicator, and said sheet center detector means produces a signal for stopping said movable base.

3. A sheet feeder according to claim 2, wherein said detectable sheet center indicator is movable along an indicator path by a distance which is ½ of the distance by which said one movable side fence moves, in response to the movement of said one movable side fence.

4. A sheet feeder according to claim 1, wherein said plurality of lifter mechanisms are operable independently of one another.

5. A sheet feeder for feeding sheets in one direction along a sheet feed path, comprising:

a fixed mount base;

a movable base movably mounted on said fixed mount base for movement across a sheet inlet in a direction perpendicularly to said one direction;

base actuator means for reciprocally moving said movable base on said fixed mount base;

a first sheet table for supporting a stack of first sheets, said first sheet table being vertically movably mounted on said movable base;

a second sheet table for supporting a stack of second sheets, said second sheet table being vertically movably mounted on said movable base, said second sheet table being positioned adjacent to said first sheet table along said direction;

sheet feed means for feeding the sheets from a selected one of said first and second sheet tables;

first table lifter means for vertically moving said first sheet table toward and away from said sheet feed means;

second table lifter means for vertically moving said second sheet table toward and away from said sheet feed means;

a side plate member substantially vertically mounted on said movable base between said firs and second sheet tables and extending toward said sheet inlet in said one direction;

a first movable side fence for positioning said stack of first sheets against said side plate member, said first movable side fence being disposed in confronting relation to a side of said side plate member and movable toward and way from said side plate member;

a second movable side fence for positioning said stack of second sheets against said side plate member, said second movable side fence being disposed in confronting relation to a side of said side plate member and movable toward and away from said side plate member;

a first detectable sheet center indicator positioned in alignment with an intermediate central position between said side plate member and said first movable side fence, and movable along an indicator path by a distance which is ½ of the distance by which said first movable side fence moves, in response to the movement of said first movable side fence;

a second detectable sheet center indicator positioned in alignment with an intermediate central position between said side plate member and said second movable side fence, and movable along said indicator path by a distance which is ½ of the distance by which said second movable side fence moves, in response to the movement of said second movable side fence; and sheet center detector means disposed at a central position of said sheet feed path and in said indicator path, for detecting either said first detectable sheet center indicator or said second detectable sheet center indicator to produce a signal for stopping movement of said movable base.

6. A sheet feeder for feeding sheets in one direction along a sheet path, comprising:

a fixed base;

a movable base movably mounted on said fixed base for movement across a sheet inlet in a direction perpendicular to said one direction;

a first sheet table for supporting a stack of first sheets, said first sheet table being vertically movably mounted on said movable base;

a second sheet table for supporting a stack of second sheets, said second sheet table being vertically movably mounted on said movable base, said second sheet table being positioned adjacent to said first sheet table along said direction;

a side plate member vertically mounted on said movable base between said first and second sheet tables and extending toward said sheet inlet in said one direction;

a first movable side fence for positioning said stack of first sheets against said side plate member, said first movable side fence being disposed in confronting relation to a side of said side plate member and being movable toward and away from said side plate member.

a second movable side fence for positioning said stack of second sheets against said side plate member, said second movable side fence being disposed in confronting relation to a side of said side plate member and being movable toward and away from said side plate member;

a first detectable sheet center indicator positioned in alignment with an intermediate central position between said side plate member and said first movable side fence, a second detectable sheet center indicator positioned in alignment with an intermediate central position between said side plate member and said second movable side fence;

sheet feed means for feeding the sheets from a selected one of said first and second sheet tables;

first table lifter means for vertically moving said first sheet table toward and away from said sheet feed means;

second table lifter means for vertically moving said second sheet table toward and away from said sheet feed means; and sheet center detector means disposed at a central position of said sheet feed path and in path of said indicator for detecting either said first detectable sheet center indicator or said second detectable sheet center indicator to produce a signal for stopping movement of said movable base.

* * * * *